US009852842B2

(12) United States Patent
Park et al.

(10) Patent No.: US 9,852,842 B2
(45) Date of Patent: Dec. 26, 2017

(54) COIL ELECTRONIC COMPONENT

(71) Applicant: SAMSUNG ELECTRO-MECHANICS CO., LTD., Suwon-Si, Gyeonggi-Do (KR)

(72) Inventors: Il Jin Park, Suwon-Si (KR); Se Hyung Lee, Suwon-Si (KR); Byeong Cheol Moon, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/995,942

(22) Filed: Jan. 14, 2016

(65) Prior Publication Data

US 2016/0351315 A1 Dec. 1, 2016

(30) Foreign Application Priority Data

May 29, 2015 (KR) ..... 10-2015-0076403

(51) Int. Cl.
*H01F 27/24* (2006.01)
*H01F 5/00* (2006.01)
(Continued)

(52) U.S. Cl.
CPC ..... *H01F 27/292* (2013.01); *H01F 17/0013* (2013.01); *H01F 17/04* (2013.01); *H01F 2017/048* (2013.01)

(58) Field of Classification Search
CPC ..... H01F 27/255; H01F 27/28; H01F 27/29; H01F 3/08; H01F 17/006; H01F 2017/0013; H01F 2017/048
(Continued)

(56) References Cited

U.S. PATENT DOCUMENTS

2010/0097171 A1* 4/2010 Urata ..... B22F 9/08 336/233
2010/0194516 A1* 8/2010 Sato ..... H01F 1/24 336/221
(Continued)

FOREIGN PATENT DOCUMENTS

JP 6-290927 A 10/1994
JP 2008-166455 A 7/2008
(Continued)

OTHER PUBLICATIONS

Korean Office Action dated May 19, 2016, issued in Korean patent application No. 10-2015-0076403. (w/ English translation).
(Continued)

*Primary Examiner* — Mangtin Lian
(74) *Attorney, Agent, or Firm* — McDermott Will & Emery LLP

(57) ABSTRACT

A coil electronic component includes a body having a coil part disposed therein and external electrodes connected to the coil part. The body includes a plurality of magnetic particles. In one example, a particle size distribution $D_{50}$ of the magnetic particles in the body is 1 μm or less. In other examples, a particle size distribution $D_{99}$ of the magnetic particles in the body is 1 μm or less; a particle size distribution ratio $D_{99}/D_{50}$ of the magnetic particles in the body is 1.5 or less; and/or a variation coefficient of the particle size of the magnetic particles in the body is 20% or less.

12 Claims, 6 Drawing Sheets

(51) Int. Cl.
*H01F 27/29* (2006.01)
*H01F 17/00* (2006.01)
*H01F 17/04* (2006.01)

(58) Field of Classification Search
USPC ..... 336/192, 221, 200, 233
See application file for complete search history.

(56) References Cited

U.S. PATENT DOCUMENTS

| | | | | |
|---|---|---|---|---|
| 2012/0188049 | A1* | 7/2012 | Matsuura | B22F 1/02 336/212 |
| 2013/0113593 | A1* | 5/2013 | Jeong | H01F 17/0013 336/200 |
| 2013/0249664 | A1* | 9/2013 | Tonoyama | H01F 41/04 336/200 |
| 2014/0184374 | A1 | 7/2014 | Park et al. | |
| 2015/0002252 | A1* | 1/2015 | Masaki | H01F 27/2876 336/192 |
| 2015/0035640 | A1* | 2/2015 | Wang | H01F 17/0006 336/200 |
| 2015/0108392 | A1 | 4/2015 | Gotoh et al. | |
| 2015/0109088 | A1 | 4/2015 | Kim et al. | |

FOREIGN PATENT DOCUMENTS

| | | | |
|---|---|---|---|
| JP | 2010261065 | A | 11/2010 |
| JP | 2013-067863 | A | 4/2013 |
| JP | 2013201375 | A | 10/2013 |
| JP | 2013236021 | A | 11/2013 |
| JP | 2015-082660 | A | 4/2015 |
| KR | 10-2009-0130054 | A | 12/2009 |
| KR | 10-2014-0085997 | A | 7/2014 |

OTHER PUBLICATIONS

Y.Shimada et al., "Production of Magnetically Soft Submicron Particles From Aqueous Solutions and Characterization", IEEE Transactions on Magnetics, U.S.A., IEEE Magnetics Society, pp. 4298-4301, No. 10, vol. 45, Sep. 22, 2009.

Japanese Office Action dated Jan. 31, 2017, issued in Japanese Application No. 2016-054126. (w/ English translation).

* cited by examiner

COIL ELECTRONIC COMPONENT

CROSS-REFERENCE TO RELATED APPLICATION

This application claims the priority and benefit of Korean Patent Application No. 10-2015-0076403 filed on May 29, 2015, with the Korean Intellectual Property Office, the disclosure of which is incorporated herein by reference.

BACKGROUND

The present disclosure relates to a coil electronic component and a method of manufacturing the same.

An inductor, an electronic component, is a representative passive element that is commonly used in electronic circuits together with a resistor and a capacitor to remove noise.

An inductor may be manufactured by forming internal coil parts, then forming a body in which the internal coil parts are embedded. End portions of the internal coil parts can be exposed, and external electrodes formed on external portions of the body.

SUMMARY

An inductor body may be formed of a magnetic material-resin composite in which the magnetic material and the resin are mixed with each other, and characteristics of the inductor may be controlled depending on characteristics of the magnetic material included in the inductor body.

An aspect of the present disclosure may provide a coil electronic component capable of being used in a high frequency band by using magnetic particles each having a significantly reduced size, and a method of manufacturing the same.

According to an aspect of the present disclosure, a coil electronic component includes a body having a coil part disposed therein, and external electrodes connected to the coil part. The body includes magnetic particles each having a small size to reduce eddy current loss. A method of manufacturing the coil electronic component is also provided.

Meanwhile, a particle size distribution $D_{50}$ of the magnetic particles may be 1 μm or less.

According to another aspect of the present disclosure, a coil electronic component may include a body having a coil part embedded therein. The body includes magnetic particles having a particle size of 1 μm or less, and a variation coefficient of the particle size of the magnetic particles in the body is 20% or less.

In a further aspect of the present disclosure, a coil electronic component may include a coil part having a hole penetrating through a center thereof, and a body enclosing the coil part and extending through the hole at the center of the coil part. The body includes magnetic particles dispersed in a thermosetting resin, and a particle size distribution ratio $D_{99}/D_{50}$ of the magnetic particles included in the body is 1.5 or less.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
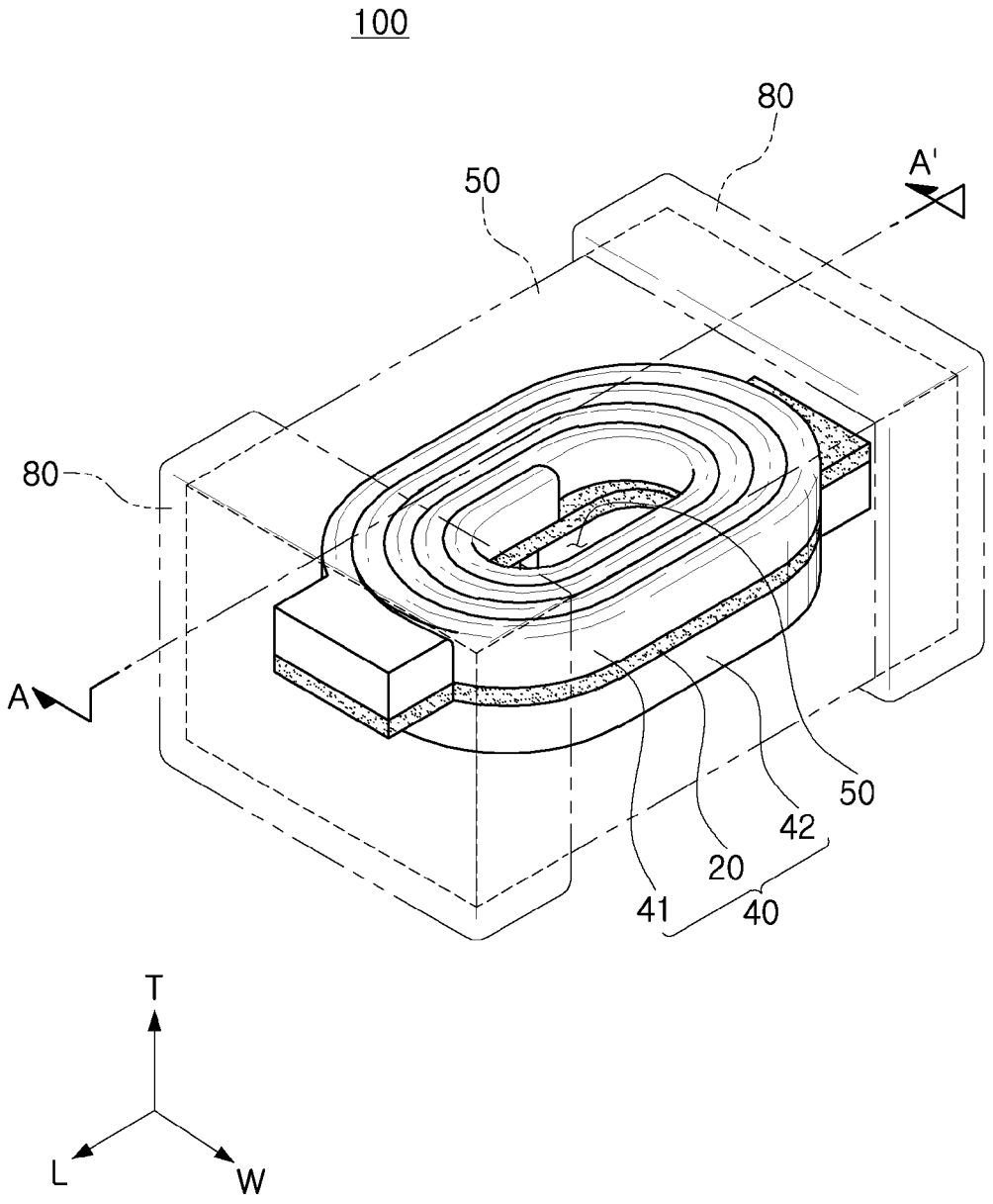
FIG. 1 is a schematic perspective view illustrating a coil electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Hereinafter, a coil electronic component according to an exemplary embodiment will be described. Particularly, an inductor will be described, but the present disclosure is not limited thereto.

Figure 2:
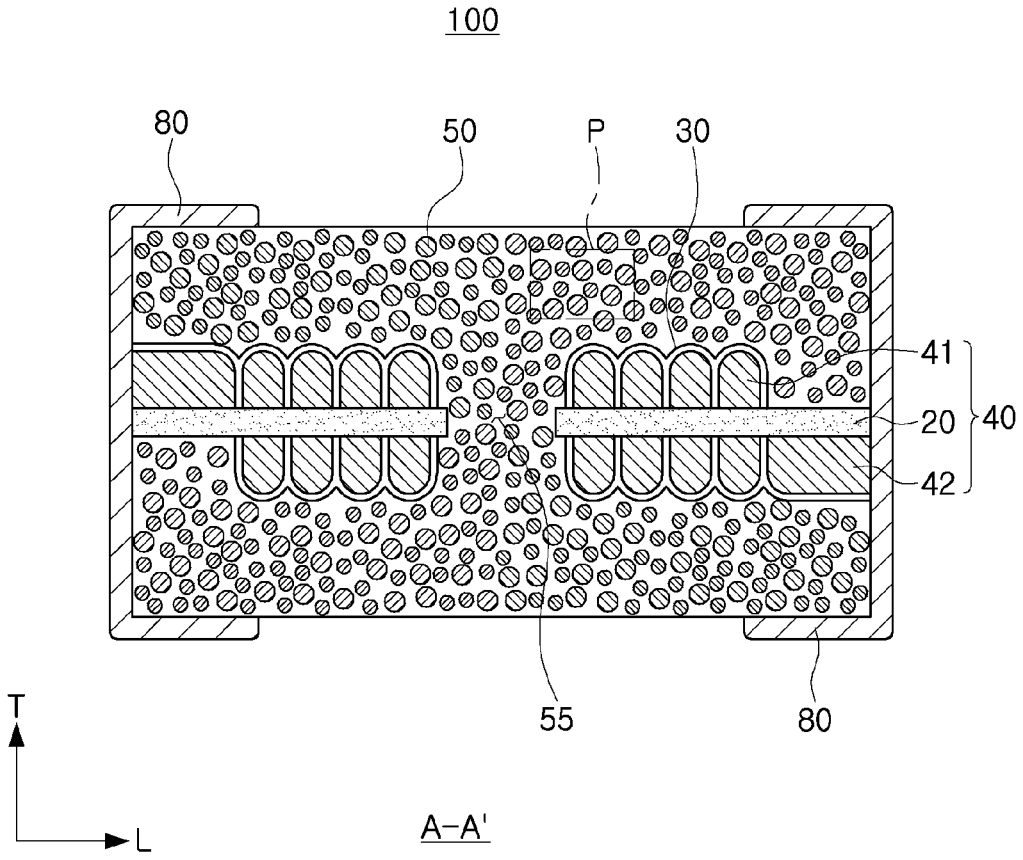
FIG. 2 is a cross-sectional view taken along line A-A' of FIG. 1.

FIG. 1 is a schematic perspective view illustrating a coil electronic component according to an exemplary embodiment in which a coil part disposed in the coil electronic component is visible, and FIG. 2 is a cross-sectional view taken along line A-A' of FIG. 1.

Referring to FIGS. 1 and 2, the inductor used in a power line of a power supply circuit is illustrated as one example of the coil electronic component. However, the coil electronic component according to an exemplary embodiment may be appropriately utilized as beads, a filter, and the like, in addition to the inductor.

The coil electronic component 100 may include a body 50 and external electrodes 80, wherein the body 50 may include a coil part 40 including a substrate layer 20 and coil patterns 41 and 42.

The body 50 may have an approximately hexahedral shape, and L, W, and T illustrated in FIG. 1 refer to a length direction, a width direction, and a thickness direction, respectively.

The body 50 may include first and second surfaces opposing each other in the thickness direction, third and fourth surfaces opposing each other in the length direction, and fifth and sixth surfaces opposing each other in the width direction. The body 50 may have a rectangular parallelepiped shape in which a dimension thereof in the length direction (i.e., a length) is larger than a dimension thereof in the width direction (i.e., a width).

The body 50 may form an appearance of the coil electronic component 100 and may be formed of a magnetic material having magnetic properties.

The magnetic material may have a powder form and may be included in the body 50 by being dispersed in a polymer such as an epoxy resin, polyimide, or the like.

As illustrated in FIG. 2, the coil part 40 may be disposed in the body 50. The coil part 40 may include the substrate layer 20 and the coil patterns 41 and 42 disposed on at least one surface of the substrate layer 20. The coil patterns 41 and 42 may alternatively be disposed on respective opposing surfaces of the substrate layer 20.

The substrate layer 20 may include, for example, polypropylene glycol (PPG), ferrite, a metal-based soft magnetic material, or the like.

A through hole may be formed in a central portion of the substrate layer 20, and may be filled with the magnetic material included in the body 50 to form a core part 55. The core part 55 may be formed by filling the through hole with the magnetic material, thereby improving or increasing an inductance (L) value of the inductor.

A first coil pattern 41 having a coil shape may be formed on one surface of the substrate layer 20, and a second coil pattern 42 having a coil shape may be formed on another surface of the substrate layer 20 opposing the one surface of the substrate layer 20.

The coil patterns 41 and 42 may be formed to have spiral shapes, and the first and second coil patterns 41 and 42 formed on one surface and the other surface of the substrate layer 20, respectively, may be electrically connected to each other though a via electrode (not illustrated) formed in and penetrating through the substrate layer 20.

One end portion of the first coil pattern 41 disposed on one surface of the substrate layer 20 may be exposed to one external surface of the body 50 in the length direction, and one end portion of the second coil pattern 42 disposed on the other surface of the substrate layer 20 may be exposed to the other external surface of the body 50 in the length direction.

The external electrodes 80 may be formed on both surfaces of the body 50 in the length direction so as to be connected to the exposed end portions of the coil patterns 41 and 42 respectively. The coil patterns 41 and 42, the via electrode (not illustrated), and the external electrodes 80 may be formed of a metal having excellent electrical conductivity, such as silver (Ag), copper (Cu), nickel (Ni), aluminum (Al), alloys thereof, or the like.

According to an exemplary embodiment, the coil patterns 41 and 42 may be covered with an insulation layer 30.

The insulation layer 30 may be formed by a method known in the art, such as a screen printing method, an exposure and development method of a photo resist (PR), a spray application method, or the like. The coil patterns 41 and 42 may be covered with the insulation layer 30 so as not to be in direct contact with the magnetic material included in the body 50.

Figure 3:
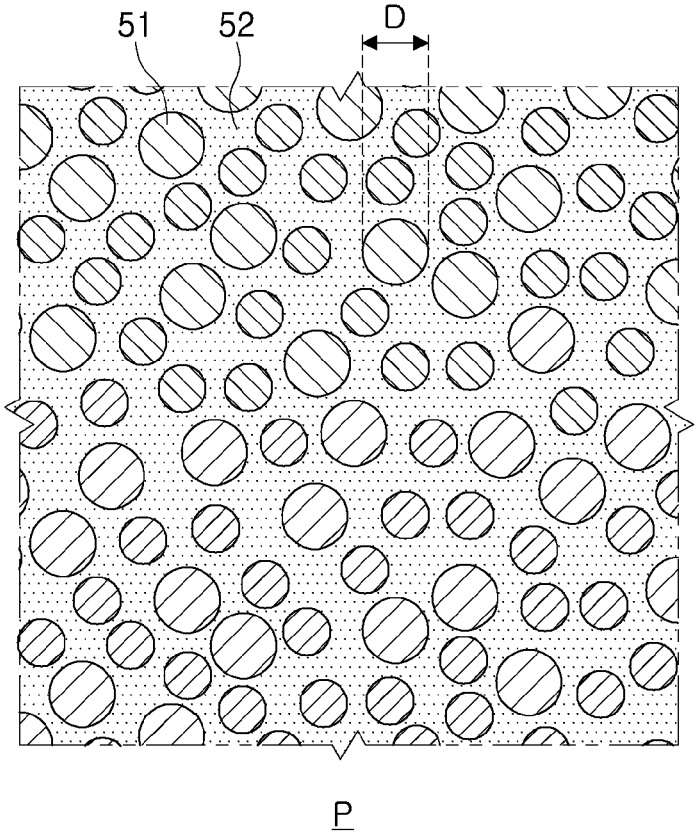
FIG. 3 is an enlarged view of a region P of FIG. 2.

FIG. 3 is an enlarged view of a region P of FIG. 2.

Referring to FIGS. 2 and 3, the body 50 may include magnetic material having magnetic properties, and as illustrated in FIG. 3, the magnetic material may have a plurality of magnetic particles 51 dispersed in a thermosetting resin 52 such as an epoxy resin, polyimide, or the like.

The body 50 may include the magnetic particles 51 having a particle size of 1 μm or less.

According to an exemplary embodiment, a particle diameter of the magnetic particles 51 may be measured by cutting an inductor body, observing a fraction of the surface obtained by the cutting with a scanning electron microscope (SEM), and analyzing an image obtained by SEM.

Specifically, a particle size distribution $D_{50}$ of the magnetic particles included in the body 50 may be 1 μm or less.

The particle size of the magnetic particles included in the body 50 may be 1 μm or less on the basis of $D_{50}$, and thus 50% or more of the magnetic particles included in the body 50 may have a size (e.g., a diameter) of 1 μm or less. This particle size distribution provides a coil electronic component that has reduced eddy current loss, and that may be used in a high frequency band.

According to an exemplary embodiment, more preferably, a particle size distribution $D_{99}$ of the magnetic particles included in the body 50 may be 1 μm or less.

The particle size of the magnetic particles included in the body 50 may be 1 μm or less on the basis of $D_{99}$, whereby the coil electronic component manufactured therefrom may have significantly reduced eddy current loss, and may be used even in a frequency band of approximately 100 MHz.

In addition, the body 50 may include the magnetic particles having the particle size of 1 μm or less, and the particle size distribution ratio $D_{99}/D_{50}$ of the magnetic particles included in the body may be 1.5 or less.

The particle size distribution $D_{50}$ of the magnetic particles included in the body 50 may be 1 μm or less, and at the same time, a particle size distribution ratio $D_{99}/D_{50}$ of the magnetic particles included in the body may be 1.5 or less.

As described above, when the body 50 includes the magnetic particles having a particle size of 1 μm or less, and the particle size distribution ratio $D_{99}/D_{50}$ of the magnetic particles is 1.5 or less, a size of the particles may be significantly reduced, and may be uniformly controlled to form a resonant frequency in a high frequency region.

More preferably, a particle size distribution ratio $D_{99.9}/D_{50}$ of the magnetic particles included in the body 50 may be 1.5 or less.

According to an exemplary embodiment, the body 50 may include the magnetic particles having a particle size of 1 μm or less, and a variation coefficient to the particle size of the magnetic particles included in the body 50 may be 20% or less.

The variation coefficient is a percentage obtained by dividing a deviation of particle size of magnetic particles included in the body into an average of the particle size of the magnetic particles. (Variation coefficient to particle size of magnetic particles=(deviation of particle size of magnetic particles/average of the particle size of the magnetic particles)×100%)

When the body 50 includes the magnetic particles having the particle size of 1 μm or less, and the variation coefficient to the particle size of the magnetic particles included in the body is 20% or less, the size of the particles may be significantly reduced, and may be uniformly controlled, thereby uniformly implementing transmittance.

In addition, the particle size distribution $D_{50}$ of the magnetic particles included in the body 50 may be 1 μm or less, and at the same time, the variation coefficient to the particle size of the magnetic particles included in the body may be 20% or less.

More preferably, the particle size distribution $D_{99}$ of the magnetic particles included in the body 50 may be 1 μm or less, and at the same time, the variation coefficient to the particle size of the magnetic particles included in the body may be 20% or less.

The particle size distribution and the variation coefficient of the magnetic particles may be measured by cutting an inductor body, observing a fraction of a surface obtained by the cutting with a scanning electron microscope (SEM), and analyzing an image obtained by the SEM, wherein at least 2000 magnetic particles may be observed on the obtained SEM image.

Meanwhile, the magnetic particles 51 may be formed of a magnetic metal material, and in this case, an electronic component may be provided that satisfies a high direct current (DC)-bias characteristic due to high saturation magnetization values of the magnetic metal material while simultaneously being usable in a high frequency band.

Meanwhile, the magnetic particles may include an amorphous magnetic metal material.

The amorphous magnetic metal material may be an Fe—B—P-based magnetic material, and may include 88 to 92 mol % of iron (Fe), 6 to 9 mol % of boron (B), and 1 to 2 mol % of phosphorus (P).

According to an exemplary embodiment, the magnetic particles may include the amorphous magnetic metal material including 88 to 92 mol % of iron (Fe), 6 to 9 mol % of boron (B), and 1 to 2 mol % of phosphorus (P). In such an exemplary embodiment, a separate seed may not be required for securing uniformity of the magnetic particles when the magnetic particles are formed. Accordingly, platinum (Pt), which is a general component of the seed, may not be included, and thus manufacturing cost of the magnetic particles may be reduced, and a manufacturing process of the magnetic particles may be simplified.

In the amorphous magnetic metal material, when a content of iron (Fe) is less than 88 mol %, a saturation magnetization value of the material may be decreased, and when the content of iron (Fe) is more than 92 mol %, a crystalline shape may be included. It may therefore be desirable to include 88 to 92 mol % of iron (Fe) in the amorphous magnetic metal material.

In the amorphous magnetic metal material, when a content of boron (B) is less than 6 mol %, the crystalline shape may be included, and when the content of boron (B) is more than 9 mol %, a saturation magnetization value of the material may be decreased. It may therefore be desirable to include 6 to 9 mol % of boron (B) in the amorphous magnetic metal material.

In the amorphous magnetic metal material, when a content of phosphorus (P) is less than 1 mol %, the crystalline shape may be included, and when a content of phosphorus (P) is more than 2 mol %, the saturation magnetization value of the material may be decreased. It may therefore be desirable to include 1 to 2 mol % of phosphorus (P) in the amorphous magnetic metal material.

The magnetic particles may be formed by a liquid phase reduction method.

For example, the magnetic particles may be formed by dissolving a metal salt in a liquid and adding a liquid reducing agent to reduce and deposit metal ions. Here, a size of the magnetic particles may be controlled by a difference in reaction rate according to the addition of the reducing agent.

According to an exemplary embodiment, the coil electronic component may include the body 50 including the magnetic particles having $D_{50}$ of 1 μm or less to reduce eddy current loss, thereby being used in a high frequency band.

In addition, according to an exemplary embodiment, the coil electronic component may maintain high Q values at the high frequency band, for example, a frequency region at which Q factor is maintained to be 60 or more may be 5 MHz to 100 MHz, and thus the coil electronic component may be used in a wide frequency region.

Method of Manufacturing Electronic Component

Figure 4:
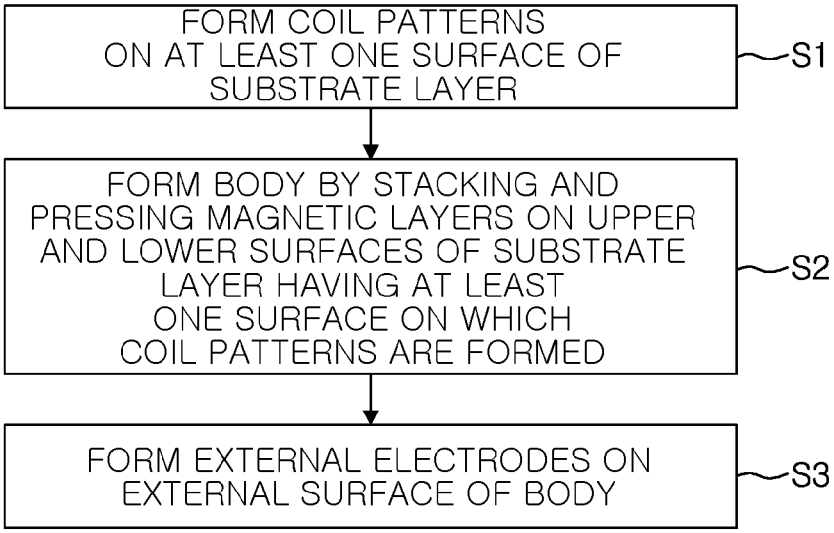
FIG. 4 is a flow chart illustrating a method of manufacturing a coil electronic component according to an exemplary embodiment in the present disclosure.

FIG. 4 is a flow chart illustrating a method of manufacturing a coil electronic component according to an exemplary embodiment, and FIGS. 5A through 5D are views illustrating sequential steps of the method of manufacturing the coil electronic component according to an exemplary embodiment.

Referring to FIG. 4, the method of manufacturing the coil electronic component according to an exemplary embodiment may include forming coil patterns on at least one surface of a substrate layer (S1), and forming a body by disposing magnetic layers on upper and lower portions of the substrate layer (S2). The body may be formed by stacking and pressing magnetic layers on upper and lower surfaces of the substrate layer having the coil patterns on at least one surface thereof.

Meanwhile, the method of manufacturing the coil electronic component according to an exemplary embodiment may further include, after the forming of the body, forming external electrodes on an external surface of the body (S3). The external electrodes may be formed so as to each be electrically connected to a respective end of the coil patterns.

Figure 5A:
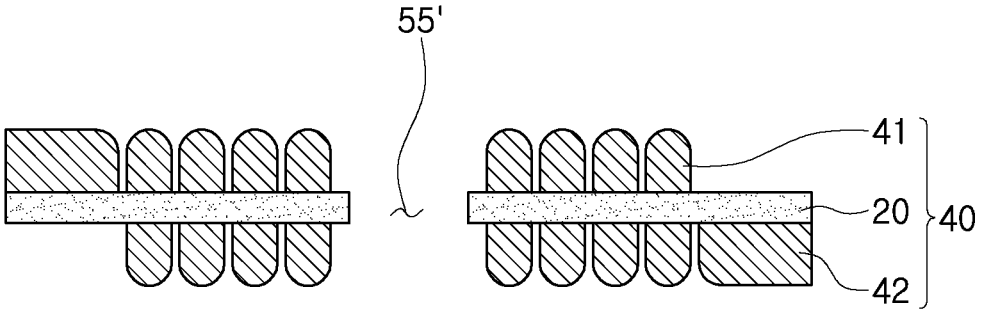
FIGS. 5A through 5D are views illustrating sequential steps of the method of manufacturing the coil electronic component according to an exemplary embodiment in the present disclosure.

Referring to FIG. 5A, a material of the substrate layer 20 is not specifically limited, and for example, may include polypropylene glycol (PPG), ferrite, a metal-based soft magnetic material, or the like. The substrate layer may have a thickness of 40 μm to 100 μm.

Although not illustrated in the drawings, the forming of the coil patterns 41 and 42 may include forming a plating resist on the substrate layer 20, the plating resist having an opening part for forming coil patterns. The plating resist, which is a general photosensitive resist film, may be a dry film resist, or the like, but the exemplary embodiment is not specifically limited thereto. In general, the plating resist may be formed on the substrate layer 20 prior to forming of the coil patterns 41 and 42.

The coil patterns 41 and 42 may be formed by filling the opening part for forming the coil patterns with an electroconductive metal using electroplating, and the like.

The coil patterns 41 and 42 may be formed of a metal having excellent electrical conductivity. For example, the coil patterns 41 and 42 may be formed of silver (Ag), palladium (Pd), aluminum (Al), nickel (Ni), titanium (Ti), gold (Au), copper (Cu), platinum (Pt), alloys thereof, or the like.

Although not illustrated, after the forming of the coil patterns 41 and 42, the plating resist may be removed by chemical etching, and the like.

When the plating resist is removed, the coil patterns 41 and 42 may be left on the substrate layer 20 as illustrated in FIG. 5A.

A via electrode (not illustrated) may be formed by forming a hole in a portion of the substrate layer 20 and providing a conductive material therein, and the coil patterns 41 and 42 formed on one surface of the substrate layer 20 and the other surface thereof may be electrically connected to each other through the via electrode. The coil patterns 41 and 42 may be electrically connected to each other in series.

A hole 55' penetrating through the substrate layer 20 may be formed in a central portion of the substrate layer 20 by a drilling method, a laser, sand blasting, punching, or the like. The hole 55' can be formed prior to or after the forming of the coil patterns 41 and 42 on the substrate layer 20.

Figure 5B:
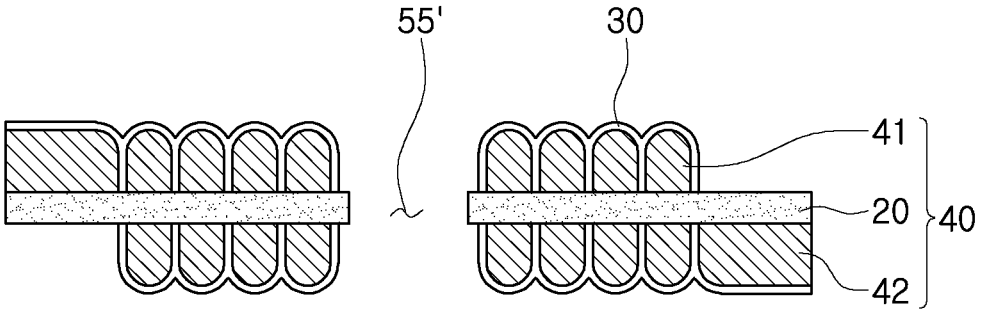

As illustrated in FIG. 5B, after the coil patterns 41 and 42 are formed, an insulation layer 30 covering the coil patterns 41 and 42 may be selectively formed. The insulation layer 30 may be formed by a method known in the art such as a screen printing method, an exposure and development method of a photo resist (PR), a spray application method, or the like, but the forming method of the insulation layer is not limited thereto.

Figure 5C:
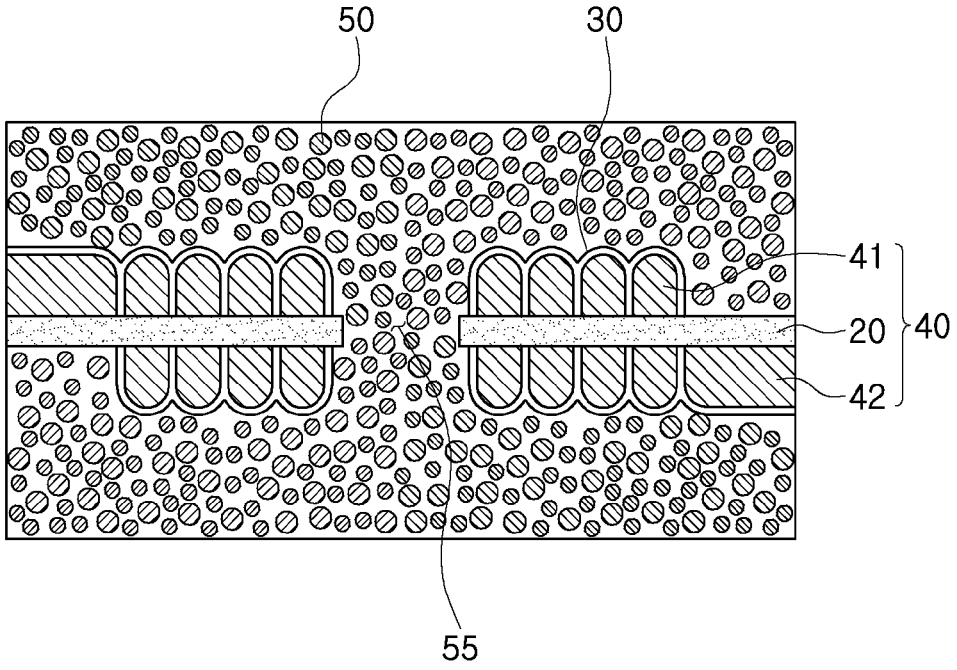

Next, as illustrated in FIG. 5C, the body 50 may be formed by disposing the magnetic layers on upper and lower portions of the substrate layer 20 on which the coil patterns 41 and 42 are formed.

The body 50 may be formed by stacking the magnetic layers on both surfaces of the substrate layer 20 and pressing the stacked magnetic layers by a lamination method or an isostatic pressing method. In this case, a core part 55 may be formed by filling the hole 55' with magnetic material. The body 50 may be formed to substantially enclose the coil patterns 41 and 42 with the exception of ends of the coil patterns 41 and 42 which may remain exposed.

Here, the magnetic layers may be formed of a magnetic paste composition for a coil electronic component. The magnetic paste composition for the coil electronic component includes magnetic particles included in the body of the coil electronic component according to an exemplary embodiment as described above.

The magnetic layer may include a plurality of magnetic particles, and a particle size distribution $D_{50}$ of the magnetic particles included in the magnetic layer may be 1 μm or less.

More preferably, a particle size distribution $D_{99}$ of the magnetic particles included in the magnetic layer may be 1 μm or less.

In addition, the magnetic layer may include magnetic particles having a particle size of 1 μm or less, and a particle size distribution $D_{99}/D_{50}$ of the magnetic particles included in the magnetic layer may be 1.5 or less.

The particle size distribution $D_{50}$ of the magnetic particles included in the magnetic layer may be 1 μm or less, and the particle size distribution ratio $D_{99}/D_{50}$ thereof may be 1.5 or less.

More preferably, a particle size distribution ratio $D_{99.9}/D_{50}$ of the magnetic particles included in the magnetic layer may be 1.5 or less.

According to an exemplary embodiment, the magnetic layer may include magnetic particles having a particle size of 1 μm or less, and a variation coefficient to the particle size of the magnetic particles included in the body may be 20% or less.

The particle size distribution $D_{50}$ of the magnetic particles included in the magnetic layer may be 1 μm or less, and a variation coefficient to the particle size of the magnetic particles included in the magnetic layer may be 20% or less.

More preferably, the particle size distribution $D_{99}$ of the magnetic particles included in the magnetic layer may be 1 μm or less, and a variation coefficient to the particle size of the magnetic particles included in the magnetic layer may be 20% or less.

Meanwhile, the magnetic particles may include an amorphous magnetic metal material.

The amorphous magnetic metal material may be an Fe—B—P-based magnetic material, and may include 88 to 92 mol % of iron (Fe), 6 to 9 mol % of boron (B), and 1 to 2 mol % of phosphorus (P).

Since a description of the method of manufacturing the coil electronic component according to an exemplary embodiment is the same as that of the above-described magnetic particles included in the coil electronic component, a detailed description of the method of manufacturing the coil electronic component will be omitted to avoid an overlapping description.

Figure 5D:
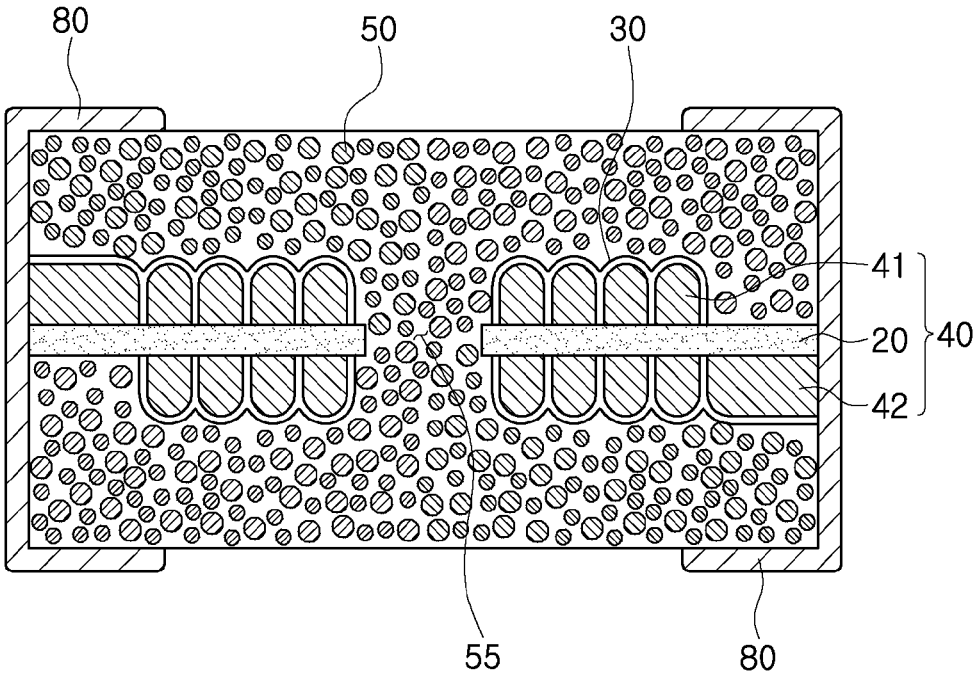

Next, as illustrated in FIG. 5D, external electrodes 80 may be formed to be connected to end portions of the coil patterns 41 and 42 exposed to at least one surface of the body 50.

The external electrodes 80 may be formed using a paste containing a metal having excellent electric conductivity, wherein the paste may be a conductive paste containing, for example, nickel (Ni), copper (Cu), tin (Sn), or silver (Ag) alone, or alloys thereof. The external electrodes 80 may be formed by a dipping method, or the like, as well as a printing method depending on a shape thereof.

Portions of the method of manufacturing the coil electronic component the same as those of the above-described coil electronic component according to an exemplary embodiment will be omitted herein to avoid an overlapping description.

Experimental Example

The coil electronic component used in the present experiment was manufactured as follows.

Toroidal cores each having an external diameter of 2 cm, a height of 0.4 cm, and a width of 0.35 cm were manufactured by mixing magnetic particles with a resin. Multiple toroidal cores were prepared with different magnetic particle distributions, the magnetic particles satisfying conditions shown in Tables 1, 2, and 3 below, and the toroidal cores were evaluated.

Table 1 below shows Q values at 100 MHz depending on $D_{50}$ of the magnetic particles included in the body of the coil electronic component.

TABLE 1

| Samples | $D_{50}$ (μm) | Q values at 100 MHz |
|---|---|---|
| 1 | 0.5 | 60 |
| 2 | 1.0 | 30 |
| 3 | 3.0 | 20 |
| 4 | 6.0 | 10 |

As shown in Table 1 above, it can be confirmed that the Q values at 100 MHz of samples 1 and 2 having $D_{50}$ of 1 μm or less are 30 or more, but the Q values at 100 MHz of samples 3 and 4 having $D_{50}$ of more than 1 μm are 20 or less.

Table 2 below shows resonant frequency values depending on $D_{99}/D_{50}$ particle size distribution ratio when $D_{50}$ of the magnetic particles included in the body of the coil electronic component is about 1 μm.

TABLE 2

| Samples | $D_{99}/D_{50}$ | Resonant Frequency (MHz) |
|---|---|---|
| 5 | 1.3 | 230 |
| 6 | 1.5 | 210 |
| 7 | 2 | 180 |
| 8 | 5 | 150 |
| 9 | 10 | 80 |

As shown in Table 2 above, the resonant frequency values of samples 5 and 6 having $D_{99}/D_{50}$ of 1.5 or less are 200 MHz or more. However, samples 7 to 9 having $D_{99}/D_{50}$ of more than 1.5 have lower resonant frequency values of 180 MHz or less.

Table 3 below shows transmittance depending on variation coefficient values when $D_{50}$ of the magnetic particles included in the body of the coil electronic component is approximately 1 μm.

TABLE 3

| Samples | Variation Coefficient (%) | Transmittance |
|---|---|---|
| 10 | 10 | 9 |
| 11 | 15 | 10 |
| 12 | 20 | 12 |
| 13 | 30 | 15 |
| 14 | 50 | 19 |

As shown in Table 3 above, samples 13 and 14 having the variation coefficient values of more than 20% have high transmittance values (15 or more) and therefore exhibit lower resonant frequency values. In contrast, samples 10, 11, and 12 having variation coefficient values of 20% or less advantageously have transmittance values of 12 or less.

Figure 6:
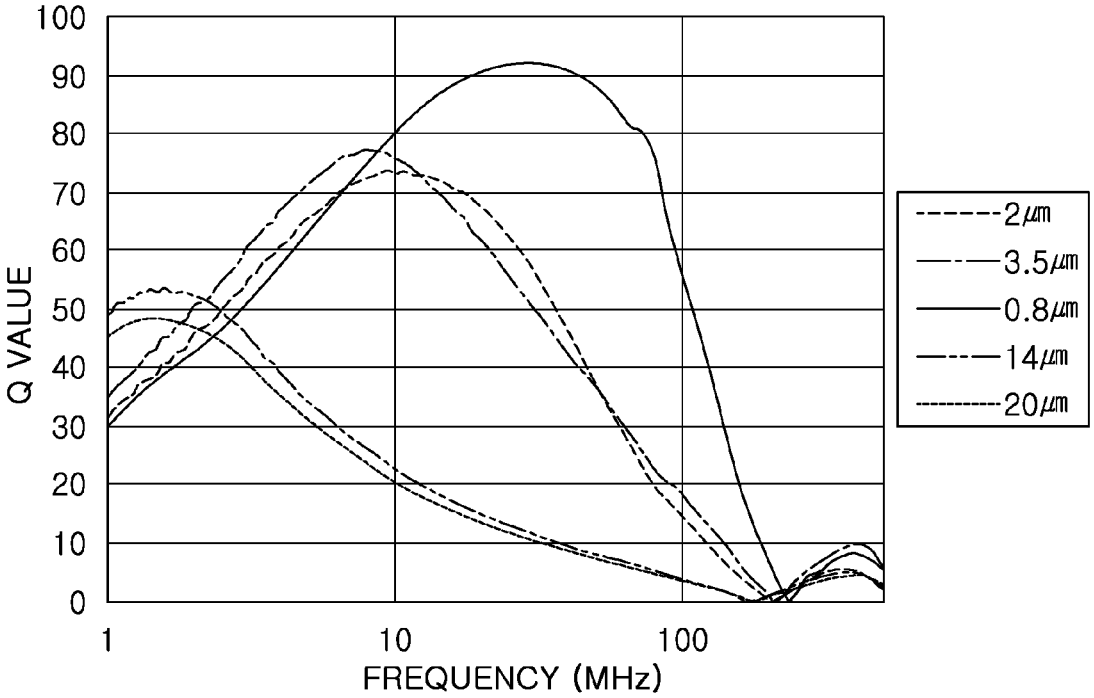
FIG. 6 is a graph illustrating results obtained by measuring Q values of coil electronic components having different sizes of magnetic particles.

FIG. 6 is a graph or plot illustrating results obtained by measuring Q values of coil electronic components as a function of frequency, wherein the coil electronic components were formed by having each body include magnetic particles having a size of (or $D_{50}$ particle size distribution of) 0.8 μm, 2 μm, 3.5 μm, 14 μm, or 20 μm, respectively.

As illustrated in FIG. 6, it can be confirmed that when $D_{50}$ was 1 μm or less (0.8 μm), high Q values are provided in a wide frequency band. In contrast, Q values are generally lower for examples including larger magnetic particle sizes.

As set forth above, according to exemplary embodiments, the coil electronic component is provided that is capable of being used in a high frequency band by reducing eddy current loss. A method of manufacturing the coil electronic component is also provided.

While exemplary embodiments have been shown and described above, it will be apparent to those skilled in the art that modifications and variations could be made without departing from the scope of the present disclosure as defined by the appended claims.

What is claimed is:

1. A coil electronic component comprising:

a body having a coil part disposed therein; and external electrodes connected to the coil part, wherein the coil part includes a plurality of windings, and a space between adjacent windings of the coil part is free of the body, wherein the body includes a plurality of magnetic particles including an amorphous magnetic metal material and having a particle size distribution $D_{99}$ that is 1 μm or less, and wherein the amorphous magnetic metal material includes 88 to 92 mol % of iron (Fe), 6 to 9 mol % of boron (B), and 1 to 2 mol % of phosphorus (P).

2. The coil electronic component of claim 1, wherein a particle size distribution ratio $D_{99}/D_{50}$ of the magnetic particles in the body is 1.5 or less.

3. The coil electronic component of claim 1, wherein a particle size distribution ratio $D_{99.9}/D_{50}$ of the magnetic particles in the body is 1.5 or less.

4. The coil electronic component of claim 1, wherein the coil part includes a substrate layer and coil patterns disposed on at least one surface of the substrate layer.

5. The coil electronic component of claim 4, wherein:

the coil patterns are disposed on two opposing surfaces of the substrate layer, a coil pattern disposed on one surface of the substrate layer is electrically connected, though a via electrode extending through a hole in the substrate layer, to a coil pattern disposed on another surface of the substrate layer opposite to the one surface, and the substrate layer includes a hole penetrating through the substrate layer in a central portion of the coil part.

6. The coil electronic component of claim 1, wherein the body further includes a thermosetting resin.

7. A coil electronic component comprising:

a body having a coil part embedded therein, wherein the body includes magnetic particles including an amorphous magnetic metal material and having a particle size of 1 μm or less, and a variation coefficient of the particle size of the magnetic particles in the body is 20% or less, wherein a particle size distribution $D_{99}$ of the magnetic particles in the body is 1 μm or less, and wherein the amorphous magnetic metal material includes 88 to 92 mol % of iron (Fe), 6 to 9 mol % of boron (B), and 1 to 2 mol % of phosphorus (P).

8. The coil electronic component of claim 7, wherein a particle size distribution ratio $D_{99}/D_{50}$ of the magnetic particles in the body is 1.5 or less.

9. The coil electronic component of claim 7, wherein a particle size distribution ratio $D_{99.9}/D_{50}$ of the magnetic particles in the body is 1.5 or less.

10. A coil electronic component comprising:

a coil part having a hole penetrating through a center thereof; and a body enclosing the coil part and extending through the hole at the center of the coil part, wherein the body includes magnetic particles dispersed in a thermosetting resin, the magnetic particles include an amorphous magnetic metal material, and a particle size distribution ratio $D_{99}/D_{50}$ of the magnetic particles included in the body is 1.5 or less, wherein a particle size distribution $D_{99}$ of the magnetic particles in the body is 1 μm or less, and wherein the amorphous magnetic metal material includes 88 to 92 mol % of iron (Fe), 6 to 9 mol % of boron (B), and 1 to 2 mol % of phosphorus (P).

11. The coil electronic component of claim 10, wherein a variation coefficient of the particle size of the magnetic particles in the body is 20% or less.

12. The coil electronic component of claim 10, wherein:

the coil part includes a substrate layer and coil patterns disposed on two opposing surfaces of the substrate layer, the coil patterns disposed on the two opposing surfaces of the substrate layer are electrically connected though a via electrode extending through the substrate layer, and the substrate layer includes the hole penetrating through the substrate layer in the center of the coil part.

* * * * *